US005365607A

United States Patent [19]

Benevento, Jr. et al.

[11] Patent Number: 5,365,607

[45] Date of Patent: Nov. 22, 1994

[54] CAP HAVING EVAPORATIVE COOLING INTERIOR APPARATUS

[76] Inventors: Vincenzo P. Benevento, Jr.; Barbara M. Benevento, both of 1 Meadowbrook, Aliso Veijo, Calif. 92656

[21] Appl. No.: 110,782

[22] Filed: Aug. 26, 1993

[51] Int. Cl.[5] ..... A42B 1/06

[52] U.S. Cl. ..... 2/181.4; 2/171.1; 2/182.6

[58] Field of Search ..... 2/7, 171.1, 171.2, 175.1, 2/181, 181.2, 181.4, 181.6, 181.8, 182.1, 182.2, 182.3, 182.5, 182.6, 195.1, 209.11, 209.12, 411, 412, 413, 414, 909, 918, DIG. 1; 128/380, 402

[56] References Cited

U.S. PATENT DOCUMENTS 1,434,745 11/1922 MacLeod ..... 2/181.4
3,289,212 12/1966 Morgan ..... 2/181.4
3,495,272 2/1970 Tempelhof ..... 2/181.4
4,101,981 7/1978 Boden ..... 2/182.6
5,101,516 4/1992 Scarnato ..... 2/181
5,226,180 7/1993 Leach ..... 2/171.1

*Primary Examiner*—Clifford D. Crowder
*Assistant Examiner*—Diana L. Biefeld
*Attorney, Agent, or Firm*—Roy A. Ekstrand

[57] ABSTRACT

A cap utilizing evaporative cooling interior apparatus includes a cap having a generally dome-shaped head covering portion defining an interior cavity. A plurality of elongated tapered porous liquid evaporating pads are removably secured within the cap interior in a spaced apart arrangement. A plurality of air passage channels are formed between the evaporative pads to promote air circulation about the pads within the cap interior. The pads are formed of a porous material having the capacity to absorb and retain a substantial quantity of liquid such as water. The pads preferably contact the user's head and provide a cooling effect thereon as the liquid within the porous pads evaporates.

15 Claims, 2 Drawing Sheets

CAP HAVING EVAPORATIVE COOLING INTERIOR APPARATUS

FIELD OF THE INVENTION

This invention relates generally to systems for cooling the wearer of a hat or cap and particularly to those utilizing liquid evaporation.

BACKGROUND OF THE INVENTION

A great variety of sports and other high exertion activities take place in high temperature environments which can often prove uncomfortable for both participants and spectators alike. In addition, many other strenuous activities whether sport, leisure or work often subject the participants to extreme heat and the accompanying fatigue and discomfort. For many years, athletes and spectators have attempted to obtain a beneficial and refreshing respite from high temperature discomfort by simply wetting their head and hair to promote evaporative cooling and dissipate heat from their heads. For example, runners and other similar athletes may often be seen utilizing water provided at the various water stations along the race course to dump some water upon their heads as they continue to run.

All of these various activities are attempts to make use of the heat dissipating benefits of water evaporation from the scalp and head. It has been found particularly effective in combating high temperature problems by cooling the head as much as possible.

Recognizing the need for improved methods of cooling a heated person's head, practitioners in the art have provided various apparatus which responds to this need. For example, U.S. Pat. No. 5,101,516 issued to Scarnato sets forth a SYSTEM FOR VENTILATING BROW BAND AREA OF A CAP/SUN VISOR in which a plurality of resilient porous absorbent members are removably secured to the interior surface of an otherwise conventional hat or sun visor. The attachment is provided using hook and loop fabric attachments spaced about the interior of the sweatband portion of the cap which would normally engage the forehead of the wearer. In its anticipated use, the porous members absorb perspiration from the wearer's forehead and provide an evaporative cooling effect. It is also anticipated that the positioning of the spaced apart porous members along the sweatband provides interleaved cooling air passages to further cool the wearer.

U.S. Pat. No. 4,101,981 issued to Boden sets forth a cap or hat made of nonventilating material which includes ventilation openings including a top opening beneath which a baffle is movably supported and to essential rigid horizontally spaced pivotally mounted spacer elements which engage the user's head to hold the band away from the front and side portion of the user's head.

U.S. Pat. No. 4,550,445 issued to Fender sets forth a ventilated athletic cap comprising an adjustable headband, a semi-rigid visor and a canopy attached to the outer edges of the visor. The canopy is made of formed cloth or semi-rigid material to maintain its shape and a spaced relationship with the head of the wearer. The canopy further contains air vents at the front and rear to permit unrestricted flow of air about the head of the wearer.

In a similar type apparatus utilized for cooling an animal, U.S. Pat. No. 4,969,317 issued to Ode sets forth an ANIMAL HAT APPARATUS AND METHOD in which a hat apparatus to protect a four-legged animal from extreme heat and direct sunlight comprises a head covering section, a brim section and a chin strap to attach to the head of an animal. The head covering section has an enclosed cavity having a liquid absorbable material for absorbing cold water in order to provide a cool hat apparatus. The head covering section has a top portion with a top liner, a right side portion with a right liner, a left side portion with a left liner, a front portion with a front liner and a rear portion with a rear liner. The liners are made of substantially leakproof material and are stitched together to enclose the cavity.

Despite the creation of such prior art devices as exemplified by those described above, there remains nonetheless a continuing unsatisfied need in the art for evermore simple, cost effective and efficient cooling apparatus for wearers of hats or caps.

SUMMARY OF THE INVENTION

Accordingly, it is a general object of the present invention to provide an improved cooling hat or cap. It is a more particular object of the present invention to provide an improved cooling hat or cap which utilizes the cooling effect of evaporating liquids such as water or the like.

In accordance with the present invention, there is provided an evaporatively cooled cap comprises: a head covering portion having an interior cavity for receiving a portion of a wearer's head; a plurality of first attachment members spaced about the interior cavity and secured therein; a plurality of elongated tapered porous pads having side edges; and a plurality of second attachment members secured to the porous pads forming cooperative attachments with the first attachment members to removably secure the porous pads within the interior cavity, the porous pads forming a spaced-apart arrangement within the interior cavity such that a plurality of air passage channels are formed between adjacent side edges of each adjacent porous pad.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENTS

Figure 1:
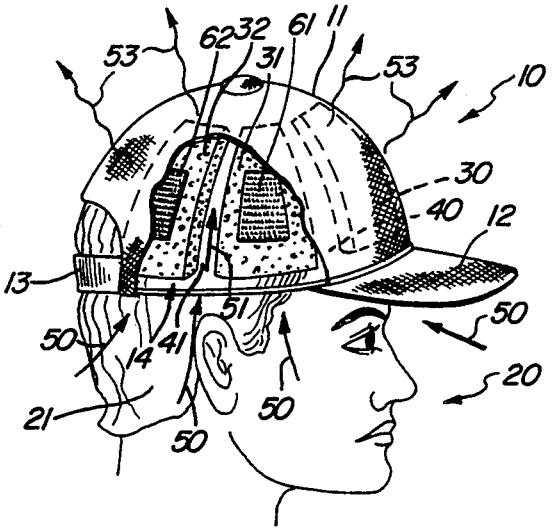
FIG. 1 sets forth a partially sectioned side view of a cap constructed in accordance with the present invention worn in a typical fashion.

FIG. 1 sets forth a partially sectioned side view of a cap constructed in accordance with the present invention and generally referenced by numeral 10. Cap 10 is shown worn by a typical wearer 20 upon head 21 thereof. Cap 10 includes a generally dome-shaped head covering portion 11 preferably formed of a woven fabric material such as cloth or the like. Cap 10 further includes a forwardly extending frontal visor 12 and a headband 13. The latter is sized to be snugly received upon the head of wearer 20. In accordance with an important aspect of the present invention, cap 10 further includes a plurality of elongated tapered porous pads 30, 31, 32, 33 and 34 (pads 33 and 34 better seen in FIGS. 2 and 3). Porous pads 30 through 34 are secured within cap interior cavity 14 by attachment to the interior surface of head covering 11 in the manner set forth below. Suffice it note here, however, that porous pads 30 through 34 support attachment pads such as attachment pads 61 and 62 shown on porous pads 31 and 32 respectively. Porous pads 30 are formed of a soft resilient porous material such as foam, sponge or the like and define generally tapering segmented members capable of absorbing significant quantities of liquid such as water. By means also set forth below in greater detail, porous pads 30 through 34 are secured within interior 14 of head covering 11 in a spaced apart relationship such that a plurality of channels 40 through 44 (better seen in FIG. 3) are formed between the porous pads.

In accordance with an important aspect of the present invention, channels 40 through 44 provide air passage channels for moisture-laden air movement within the interior of cap 10. Thus, in accordance with the invention, air from the outside of cap 10 indicated by arrows 50 is drawn upwardly through head covering 11 and into contact with pads 30 through 34. In further accordance with the present invention, porous pads 30 through 34 are substantially moistened using a liquid such as water and are maintained in general contact with the underlying portion of head 21 of wearer 20. Thus, as heat is transferred from head 21 of wearer 20 to porous pads 30 through 34 due to the direct contact therebetween, the moisture within porous pads 30 through 34 is evaporated carrying heat from pads 30 through 34 and cooling head 21 of wearer 20. The cooling action of cap 10 is further improved by the passage of air from the exterior of cap 10 through head covering 11 due to its woven fabric and therefore porous characteristic into channels 40 through 44 between pads 30 through 34. As air moves through channels 40 through 44 within cap 10, it tends to travel upwardly in the direction indicated by arrows 51 between pads 30 through 34 and thus carries evaporated moisture heat away from the surface of head 21 of wearer 20. This moisture bearing heat carrying air is permeated outwardly through head covering 11 in the manner indicated by arrows 53.

Thus, the wearer is able to transfer an evaporative liquid such as water to porous pads 30 through 34 in any convenient manner such as removing cap 10 and pouring liquid into interior 14 of cap 10 causing liquid to be absorbed by porous pads 30 through 34. Alternatively, the user may simply dump a container of water upon head covering 11 while cap 10 is being worn causing a similar liquid absorption by pads 30 through 34. As described below in greater detail, pads 30 through 34 are removably secured within the interior of head covering 11 by various attachment means. In the embodiment shown in FIGS. 1 through 4, a plurality of hook and loop fabric attachment pads are utilized to removably secure porous pads 30 through 34 within cap interior 14. Thus, porous pads 30 through 34 are removable from cap 10 to facilitate the laundering of cap 10 and the replacement and renewal of porous pads 30 through 34 as needed.

It will be apparent to those skilled in the art that a variety of materials may be utilized to fabricate porous pads 30 through 34. Thus, as mentioned above, porous pads 30 through 34 are preferably formed of a resilient porous material such as sponge or foam plastic or the like. Alternatively, porous pads 30 may be fabricated of a plurality of fibers such as multiple layers of textile cloth or the like with the essential feature being the ability of pads 30 through 34 to absorb and retain substantial quantities of an evaporative liquid such as water while concurrently possessing the required flexibility to conform to head 21 of wearer 20 to maximize contact with the wearer's head and the transfer of heat from the wearer's head to the porous pads.

Figure 2:
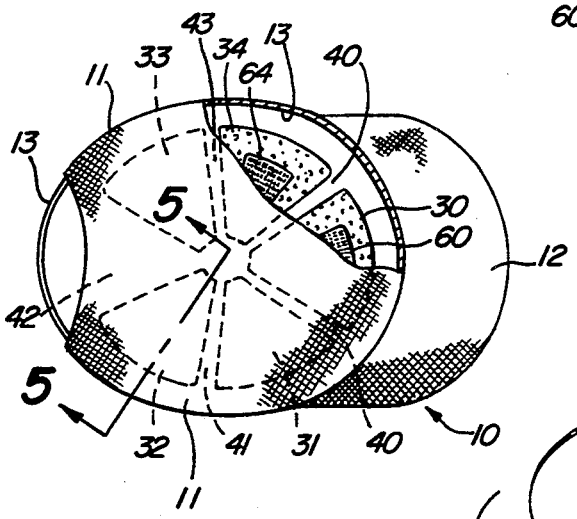
FIG. 2 sets forth a partially sectioned top view of the present invention cap.

FIG. 2 sets forth a partially sectioned top view of cap 10. As described above, cap 10 includes a head covering portion 11, a forwardly extending visor 12 and a headband 13. As is also described above, head covering portion 11 defines a cap interior 14 within which a plurality of porous pads 30 through 34 are supported by a plurality of attachment pads 60 through 64 (better seen in FIG. 3). Porous pads 30 through 34 define generally tapering elongated members supported within interior 14 of head covering 11 in a spaced apart relationship to define a plurality of air passage channels 40 through 44 between adjacent porous pads. Thus, channel 40 is formed between pads 30 and 31 while channel 41 is formed between pads 31 and 32. In a similar fashion, channel 42 is formed between pads 32 and 33, channel 43 is formed between pads 33 and 34, and channel 44 is formed between pads 34 and 30. As can be seen in FIG. 2, attachment pads 60 and 64 are supported upon porous pads 30 and 34 respectively.

Figure 3:
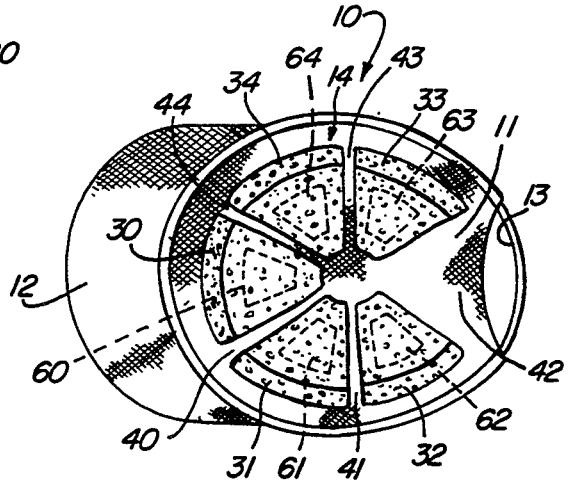
FIG. 3 sets forth a bottom view of the present invention cap.

FIG. 3 sets forth a bottom view of cap 10 having porous pads 30 through 34 secured therein. As described above, cap 10 includes a head covering portion 11 defining an interior cavity 14 and a forwardly extending visor 12. A headband 13 encircles the interior of head covering 11. As is also described above, cap 10 includes a plurality of flexible porous pads 30 through 34 having respective fabric attachment pads 60 through 64 secured within interior 14 of head covering 11. As is also described above, a plurality of air passage channels 40 through 44 are formed between adjacent pairs of pads 30 through 34.

Figure 4:
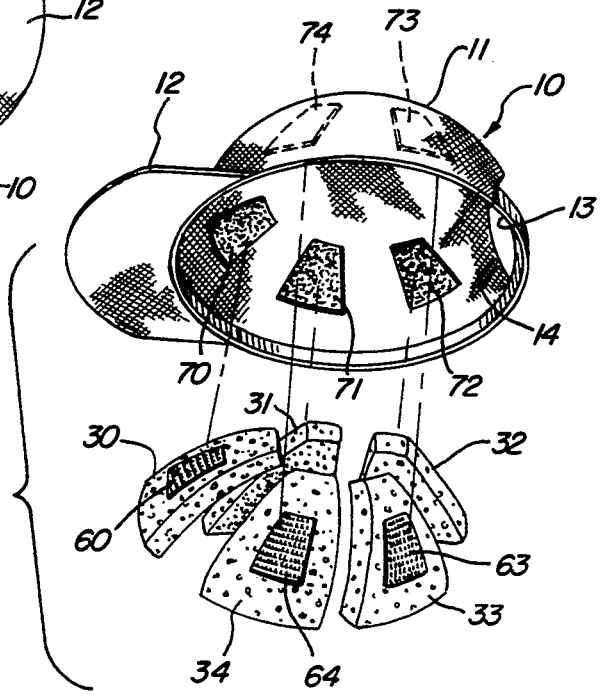
FIG. 4 sets forth a perspective assembly view of the present invention cap.

FIG. 4 sets forth a perspective assembly view of cap 10 showing porous pads 30 through 34 removed therefrom. As described above, cap 10 includes a generally dome-shaped head covering portion 11 defining a cap interior 14 and a headband 13. Cap 10 further includes a forwardly extending visor 12. In accordance with an important aspect of the present invention, a plurality of hook and loop attachment pads 70 through 74 are spaced about the interior of cap 10. In further accordance with an important aspect of the present invention, a corresponding plurality of porous pads 30 through 34 each having a respective fabric attachment pad 60 through 64 secured thereto are received within interior 14 of cap 10 and secured within head covering portion 11 thereof by the cooperating attachment of attachment pads 70 through 74 and attachment pads 60 through 64. For example, attachment pads 60 through 64 may comprise pads of hook portion attachment elements while pads 70 through 74 may comprise pads of loop attachment elements such that the cooperation between attachment pads 60 through 64 and 70 through 74 respectively provides a hook and loop attachment for porous pads 30 through 34. It will be apparent to those skilled in the art, however, that the hook and loop elements may be interchanged with pads 60 through 64 utilizing loop elements while pads 70 through 74 utilize hook elements. The important aspect with respect to the present invention is the removable attachment of porous pads 30 through 34 within head covering 11 to provide the above-described spaced apart arrangement of evaporative porous pads having elongated air passage channels formed therebetween.

It will be apparent to those skilled in the art that while the embodiment shown in FIGS. 1 through 4 utilizes an arrangement of five porous pads, other arrangements of greater or lesser numbers of porous pads may be utilized without departing from the spirit and scope of the present invention. Thus, it may be desirable in certain circumstances to utilize a lesser number of such as four or a greater number such as six, seven or even eight porous pads to suit the particular needs of the user. The important aspect is the flexible head contacting characteristic of the porous pads together with their capability to absorb and retain water for evaporative cooling together with the arrangement of porous pads within the interior of the cap to form elongated upwardly extending evaporative air channels between the pads.

Figure 5:
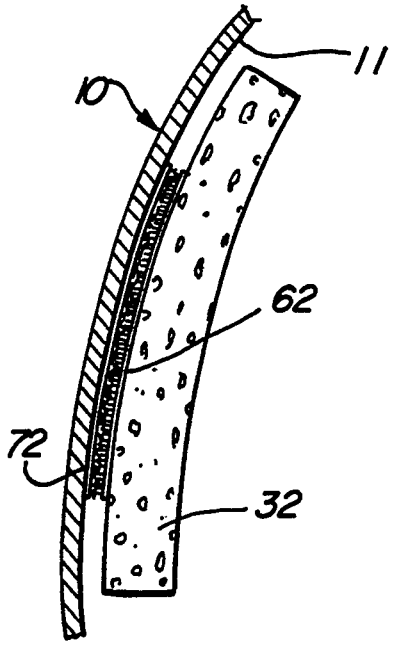
FIG. 5 sets forth a partial section view of the present invention cap taken along section lines 5—5 in FIG. 2.

FIG. 5 sets forth a partial section view of cap 10 taken along section lines 5—5 in FIG. 2. Porous pad 32 supports an attachment pad 62 comprising one element of a hook and loop fabric attachment apparatus. Correspondingly, an attachment pad 72 is secured to the interior surface of head covering 11 and forms a corresponding cooperating fabric attachment pad. Attachment pads 62 and 72 in their preferred form comprise the popular fabric hook and loop attachment apparatus which in turn provides the easy attachment and removal of porous pad 32. Attachment pad 72 may be secured within head covering 11 using conventional adhesive attachment or, alternatively, may be secured therein using a plurality of sewn seams. Similarly, porous pad 32 may be secured to attachment pad 62 using conventional adhesive means or other attachment means such as conventional sewing or the like.

It should be understood that the attachment of pad 32 to head covering 11 by attachment pads 62 and 72 is set forth in FIG. 5 by way of example and applies equally well to the attachment of porous pads 30, 31, 33 and 34 to the interior of head covering 11 in the manner described above. Thus, each of the respective porous pads supports a corresponding attachment pad which cooperates with attachment pads 70 through 74 in securing porous pads 30 through 34 within cap 10.

Figure 6:
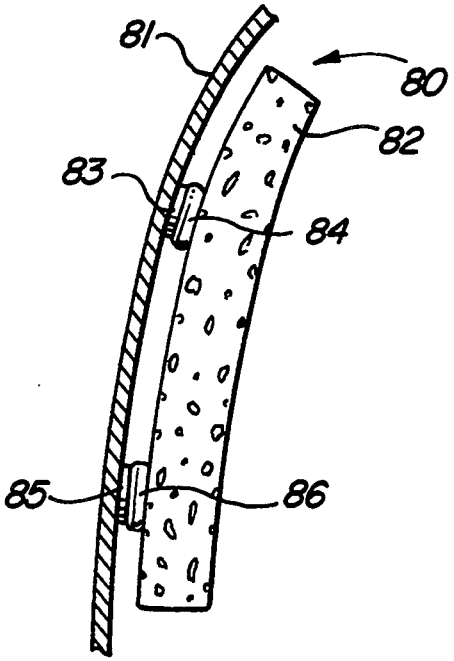
FIG. 6 sets forth a partial section view of an alternate embodiment of the present invention cap.

FIG. 6 sets forth a partial section view of an alternate embodiment of the present invention. It should be understood that the alternate embodiment of FIG. 6 is substantially identical to that set forth above in FIGS. 1 through 5 with the exception that a plurality of snap fasteners such as conventional metal fasteners are used to secure the porous pads within the interior of the cap. Thus, cap 80 includes a dome-shaped head covering 81 having a plurality of snap fastening elements 83 and 85 secured to the inner surface thereof. A porous pad 82 formed of a flexible porous material supports a corresponding pair of snap fasteners 84 and 86. Snap fasteners 84 and 86 are received within snap fasteners 83 and 85 respectively to secure porous pad 82 within the interior of cap 80. As mentioned above, cap 80 corresponds in all other respects apart from the snap fastener attachment of porous pads to the embodiment set forth above in FIGS. 1 through 5. Thus, it should be understood that a plurality of porous pads are utilized in cap 80 and are secured by respective pairs of cooperating snap fasteners such as fasteners 83 and 84 and fasteners 85 and 86. In their preferred form, snap fasteners 83 through 86 include conventional metal fastening elements having a resilient snapping attachment between pairs thereof.

Figure 7:
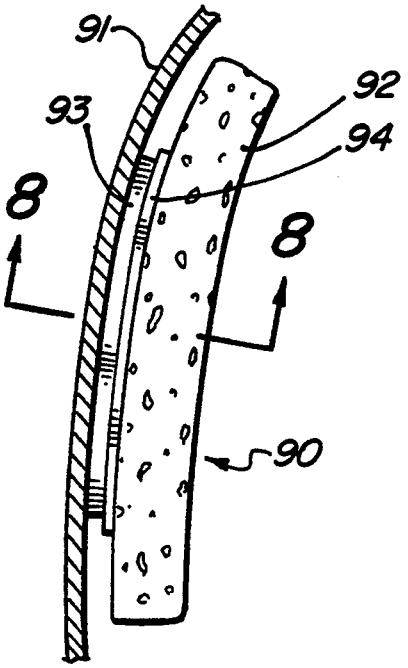
FIG. 7 sets forth a partial section view of a still further alternate embodiment of the present invention.
Figure 8:
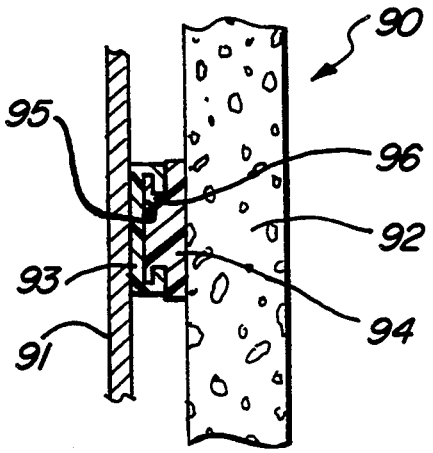
FIG. 8 sets forth a partial section view of the alternate embodiment of FIG. 7 taken along section lines 8—8 therein.

FIGS. 7 and 8 set forth partial section views of a still further alternate embodiment of the present invention cap generally referenced by numeral 90. Cap 90 corresponds in all respects to cap 10 set forth above in FIGS. 1 through 5 with the exception that the porous pads of cap 90 are secured within the cap interior using a molded plastic attachment apparatus for each porous pad.

With specific reference to FIG. 7, cap 90 includes a generally dome-shaped head covering 91 within which an elongated attachment member 93 is secured. Attachment member 93 is secured to the interior of head covering 91 using a conventional adhesive attachment or other conventional attachment apparatus. A porous pad 92 formed of a flexible absorbent porous material supports a cooperating attachment member 94 preferably formed of a molded plastic material or the like. Attachment member 94 is slidably received upon attachment member 93 to secure porous pad 92 within head covering 91 of cap 90. As mentioned above, cap 90 corresponds to cap 10 described above in all respects with the exception of the use of molded plastic attachment members such as attachment members 93 and 94 to slidably secure the porous pads within the cap interior. Thus, it will be apparent to those skilled in the art that cap 90 supports a plurality of porous pads all secured in the manner shown for porous pad 92.

FIG. 8 set forth a partial section view of the molded plastic attachment of cap 90 taken along section lines 8—8 in FIG. 7. As described above, cap 90 includes a head covering 91 supporting a molded plastic attachment member 93. Attachment member 93 defines an interior channel 95 extending its entire length. A porous pad 92 supports a molded plastic attachment member 94 having an outwardly extending T-shaped slide portion 96 which is received within channel 95 of attachment member 93. Thus, slide 96 is received within channel 95 and completes the attachment of attachment member 94 and porous pad 92 to attachment member 93.

What has been shown is a novel cap utilizing evaporative cooling within the cap interior by providing a plurality of elongated tapered evaporative pads supported within the cap interior in a spaced apart arrangement. The removable attachment of the evaporative pads provides convenient laundering of the cap and replacement and renewal of the porous evaporative pads. The spaced apart arrangement of the porous pads forms a plurality of air passage channels between adjacent pads to promote air travel among the pads and further improve the cooling action of the present invention cap. The cap may be fabricated in general accordance with conventional fabrication means with the addition of appropriate attachment members to receive and secure the porous evaporative pads.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. An evaporatively cooled cap comprising:

a head covering portion defining a lower edge and having an interior cavity for receiving a portion of a wearer's head;

a headband attached to said lower edge and having an inner surface for fitting snugly upon a wearer's head;

a plurality of first attachment members spaced about said interior cavity substantially above said headband and secured therein;

a plurality of elongated tapered porous pads each having side and bottom edges; and a plurality of second attachment members secured to said porous pads above said bottom edges thereof, said second attachment members forming cooperative attachments with said first attachment members to removably secure said porous pads within said interior cavity and being spaced from said bottom edges a sufficient distance to maintain said bottom edges of said porous pads above said headband, said porous pads forming a spaced-apart arrangement within said interior cavity such that a plurality of air passage channels are formed between adjacent side edges of each adjacent porous pad.

2. An evaporatively cooled cap as set forth in claim 1 wherein said porous pads are generally trapezoidal.

3. An evaporatively cooled cap as set forth in claim 2 wherein said porous pads are formed of a resilient open-celled material.

4. An evaporatively cooled cap as set forth in claim 3 wherein said open-celled material is sponge.

5. An evaporatively cooled cap as set forth in claim 3 wherein said open-celled material is foam plastic.

6. An evaporatively cooled cap as set forth in claim 1 wherein said first and second attachment members include hook and loop fabric attachment pads respectively.

7. An evaporatively cooled cap as set forth in claim 6 wherein said porous pads are formed of a resilient open-celled material.

8. An evaporatively cooled cap as set forth in claim 7 wherein said open-celled material is sponge.

9. An evaporatively cooled cap as set forth in claim 7 wherein said open-celled material is foam plastic.

10. An evaporatively cooled cap as set forth in claim 1 wherein said first and second attachment members include loop and hook fabric attachment pads respectively.

11. An evaporatively cooled cap as set forth in claim 1 wherein said first and second attachment members include snap fasteners.

12. An evaporatively cooled cap as set forth in claim 11 wherein said porous pads are formed of a resilient open-celled material.

13. An evaporatively cooled cap as set forth in claim 12 wherein said open-celled material is sponge.

14. An evaporatively cooled cap as set forth in claim 12 wherein said open-celled material is foam plastic.

15. An evaporatively cooled cap as set forth in claim 1 wherein said first attachment members each include an elongated member defining an interior channel therein and wherein said second attachment members each include an elongated slide receivable within one of said interior channels.

* * * * *